US008517181B1

(12) United States Patent
Davis et al.

(10) Patent No.: US 8,517,181 B1
(45) Date of Patent: Aug. 27, 2013

(54) MULTI-DISC ASSEMBLY FOR DISC SCREEN

(75) Inventors: Robert M. Davis, National City, CA (US); James Douglas Weller, National City, CA (US)

(73) Assignee: CP Manufacturing, Inc., San Diego, CA (US)

( * ) Notice: Subject to any disclaimer, the term of this patent is extended or adjusted under 35 U.S.C. 154(b) by 0 days.

(21) Appl. No.: 13/357,052

(22) Filed: Jan. 24, 2012

Related U.S. Application Data

(63) Continuation of application No. 13/069,925, filed on Mar. 23, 2011.

(51) Int. Cl.
*B07B 13/00* (2006.01)

(52) U.S. Cl.
USPC ... 209/672; 209/671; 29/895.21; 29/895.213; 492/38

(58) Field of Classification Search
USPC ..... 209/271, 667, 671, 672; 29/525.01, 29/525.02, 525.03, 895.2, 895.21, 895.213; 492/38, 40; 403/204, 286, 293
See application file for complete search history.

(56) References Cited

U.S. PATENT DOCUMENTS

| | | | | |
|---|---|---|---|---|
| 2,743,813 | A * | 5/1956 | Erickson | 209/668 |
| 2,973,093 | A * | 2/1961 | Erickson | 209/667 |
| 3,028,957 | A * | 4/1962 | Conway et al. | 209/672 |
| 3,306,441 | A * | 2/1967 | Sanders et al. | 209/672 |
| 4,402,390 | A * | 9/1983 | Feeney | 193/37 |
| 4,795,036 | A * | 1/1989 | Williams | 209/667 |
| 5,868,036 | A * | 2/1999 | Salzman | 74/450 |
| 6,318,560 | B2 * | 11/2001 | Davis | 209/672 |
| 7,261,209 | B2 | 8/2007 | Duncan et al. | |
| 7,578,396 | B1 * | 8/2009 | Garzon | 209/667 |
| 7,661,537 | B1 * | 2/2010 | Sewell | 209/671 |

* cited by examiner

*Primary Examiner* — Joseph C Rodriguez
(74) *Attorney, Agent, or Firm* — Thibault Patent Group

(57) ABSTRACT

A multi-disc assembly for releasable attachment to the shaft of a disc screen is provided. The multi-disc assembly includes a multi-disc hub of elastomeric material including multiple discs configured for use in the disc screen. The hub has a through bore configured for direct engagement over a shaft of the disc screen. A disc screen comprising the multi-disc assembly and method of using the multi-disc assembly are also provided.

12 Claims, 3 Drawing Sheets

MULTI-DISC ASSEMBLY FOR DISC SCREEN

CROSS REFERENCE TO RELATED APPLICATION

This application is a continuation of application Ser. No. 13/069,925 filed Mar. 23, 2011 incorporated herein in its entirety by this reference.

FIELD OF THE INVENTION

The present invention relates to machines used to separate particulate materials or mixed recyclable materials into difference fractions, and more particularly, to a disc assembly for a disc screen that allows its discs to be more easily removed and replaced.

RELATED ART

Disc screens have long been used to separate particulate materials such as wood chips into difference fractions, according to size. More recently disc screens have been used to separate or classify mixed recyclable materials into respective streams of similar materials such as broken glass, containers, mixed paper and newspaper.

A disc screen typically includes a frame in which a plurality of rotatable shafts are mounted in parallel relationship. A plurality of discs are mounted on each shaft and a chain drive rotates the shafts in the same direction. The discs on one shaft interleave with the discs on each adjacent shaft to form screen openings between the peripheral edges of the discs. The size of the openings determines the dimension (and thus the type) of material that will fall through the screen. Rotation of the discs, which have an irregular outer contour, agitates the mixed recyclable materials to enhance classification. The rotating discs also propel the larger articles which are too big to fall between the discs across the screen. The general flow direction extends from an input area where the stream of material pours onto the disc screen to an output where the larger articles pour off of the disc screen. The smaller articles fall between the discs onto another disc screen or a conveyor, or into a collection bin.

The discs of a disc screen normally have a central opening or bore that allows them to be slid over the end of a shaft which may have a round or square cross-section. See for example U.S. Pat. No. 4,836,388 of Bielagus granted Jun. 6, 1989. Over time, the discs wear out and must be replaced. It is not practical to re-surface or repair damaged or worn discs without removing them from the shafts of the disc screen. However, it is tedious to dismount the ends of the shafts of a disc screen from their respective bearings so that the old discs can be removed and replaced by sliding the discs off the ends of the shafts. Moreover, if only single disc is worn out or broken, it is usually necessary to remove several discs before the damaged or broken disc can be slid off the shaft. In order to alleviate these problems, a split disc was developed by CP Manufacturing, Inc. of National City, Calif. See U.S. Pat. No. 6,318,560 of Robert M. Davis granted Nov. 20, 2001. The split disc is comprised of two identical halves which are assembled around a shaft and tightly held together by a pair of bolt assemblies which clamp the disc to the shaft. Each disc half is made of an outer rubber portion which is stiffened with a rigid internal metal frame embedded inside the rubber portion.

While the split disc design is beneficial in removing particular discs without disturbing other discs on the shaft, typical disc screens may employ 600 or more discs. With so many discs, the process of replacing one disc at a time may still be too-time consuming. In order to alleviate these problems, multi-disc assemblies have been developed as demonstrated in U.S. Pat. No. 7,261,209 to Duncan, et. al. The multi-disc assemblies comprise multiple discs that can be replaced at the same time, reducing the amount of effort in servicing a disc screen. However, the multi-disc assembly of Duncan involves a complex mounting arrangement involving a securing hub and mounting plate between the multi-disc assembly and the shaft. Thus, it would be desirable to provide a multi-disc assembly that is even more convenient to remove and install.

SUMMARY

In accordance with an embodiment of the present invention, a multi-disc assembly for releasable attachment to the shaft of a disc screen is provided. The multi-disc assembly includes a multi-disc hub of elastomeric material including multiple discs configured for use in the disc screen. The hub has a through bore configured for direct engagement over a shaft of the disc screen. The hub has a longitudinal separation plane which splits the hub into two separate multi-disc hub halves. The longitudinal separation plane defines first and second radial end faces in each hub half which extend along opposite sides of the through bore and oppose corresponding first and second radial end faces in the other hub half. Each hub half has at least one first connecting portion extending up to the first radial end face and at least one second connecting portion extending up to the second radial end face. The multi-disc assembly also includes a first rigid insert between the opposing first radial end faces and a second rigid insert between the opposing second radial end faces. The multi-disc assembly also includes at least two fastener devices configured to releasably secure the hub halves together around the shaft. The fastener devices include a first fastener device configured to extend through the first connecting portions of the hub halves and the first rigid insert and a second fastener device configured to extend through the second connecting portions of the hub halves and the second rigid insert.

Other features and advantages of the present invention will become more readily apparent to those of ordinary skill in the art after reviewing the following detailed description and accompanying drawings.

DETAILED DESCRIPTION

Figure 1:
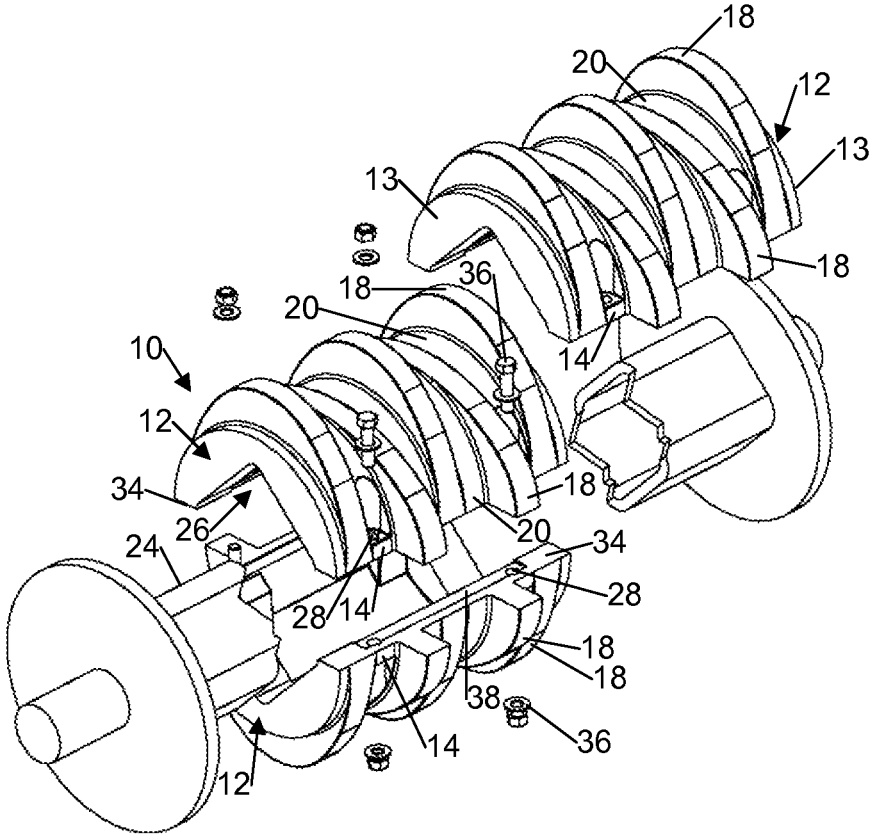
FIG. 1 is an exploded perspective view of a multi-disc assembly and a shaft of a disc screen.
Figure 2:
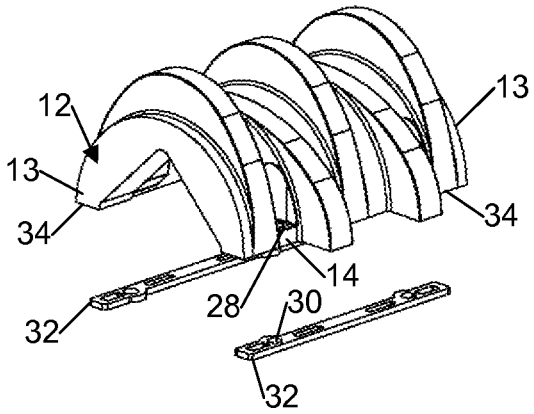
FIG. 2 is a perspective view of a multi-disc hub half and rigid inserts.
Figure 3:
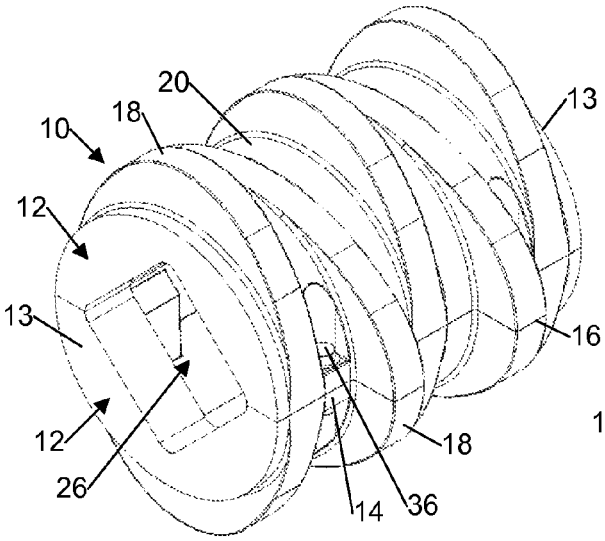
FIG. 3 is perspective view of a multi-disc assembly.
Figure 4:
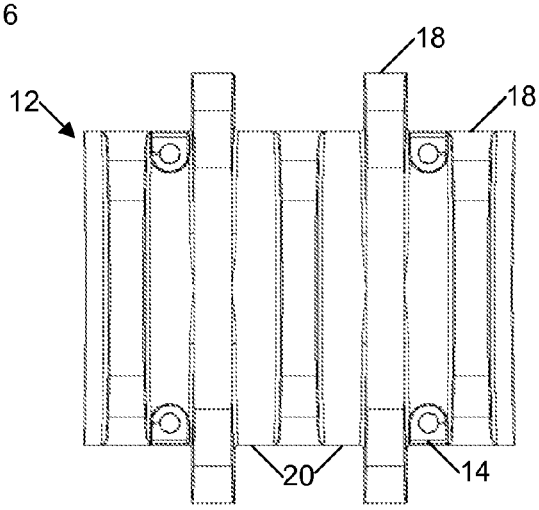
FIG. 4 is a top plan view of a multi-disc hub.

FIGS. 1 to 8 illustrate one embodiment of a multi-disc assembly 10. In FIG. 1, a multi-disc assembly 10 is positioned about a hollow rectangular shaft 24 with radial corners. While shown in an exploded view in FIG. 1, the multi-disc assembly 10 is configured for direct engagement with the shaft 24 when assembled as shown in FIG. 3. Only a portion of the shaft 24 is shown in FIG. 1. The shaft would typically be long enough to support more multi-disc assemblies. The ends of the shaft 24 are supported by bearing assemblies (not illustrated) of a disc screen (not illustrated) such as those disclosed in U.S. Pat. No. 6,250,478 of Robert M. Davis granted Jun. 26, 2001 and U.S. Pat. No. 6,648,145 of Robert M. Davis et al. granted Nov. 18, 2003, and co-pending U.S. patent application Ser. No. 10/044,222 of Robert M. Davis filed Nov. 21, 2005, the entire disclosures of which are incorporated herein by reference.

The multi-disc assembly 10 is basically two opposing multi-disc hub halves 12, a pair of rigid inserts 32 located between the hub halves 12, and fasteners 36 which secure the hub halves and inserts around the shaft 24, as described in more detail below. The hub halves 12 are positioned on opposing sides of the shaft 24. Each hub half 12 has a plurality of integrally formed discs 18 with spacers 20 positioned between adjacent pairs of the discs 18. The discs 18 are specially configured for use in classifying mixed recyclable materials. In particular, the discs 18 are configured for engaging materials to be classified (not illustrated) and propelling the materials in a conveying direction when the multi-disc assembly 10 is rotated. For example, if the multi-disc assembly 10 is rotated clock-wise in FIG. 1 the materials would be propelled to the right. A through bore 26 in multi-disc assembly 10 is configured for direct engagement with the shaft 24. In one embodiment, the through bore 26 is rectangular with radial corners. The through bore 26 interfaces with the shaft 24 in order to maintain the multi-disc assembly 10 in a fixed relationship with respect to the shaft 24. In alternative embodiments, multi-disc assemblies may be provided with through bores of different shapes, such as circular or other shapes for engaging around shafts of corresponding shape.

A longitudinal separation plane 16 (see FIG. 3) divides the two hub halves 12. The longitudinal separation plane defines radial end faces 34 of the hub halves 12. The radial end faces 34 extend on opposites sides of the through bore 26 on each hub half 12. The radial end faces 34 of one hub half 12 oppose the radial end faces 34 in the opposing hub half 12.

Figure 7A:
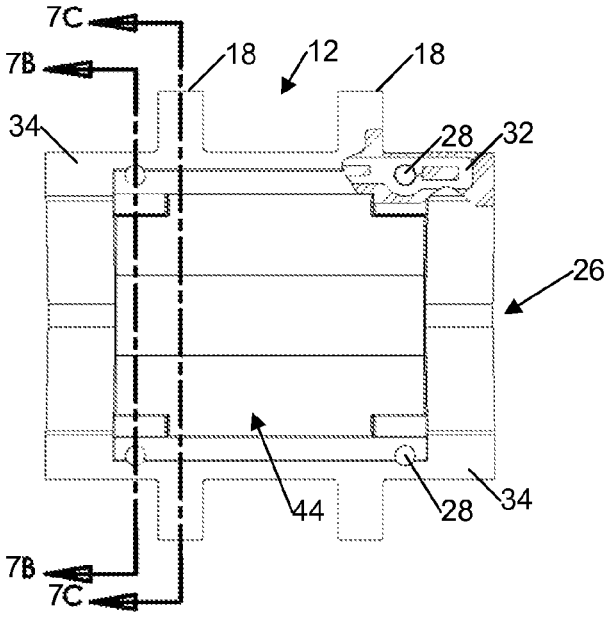
FIG. 7A is a bottom plan view of a multi-disc hub half.
Figure 7B:
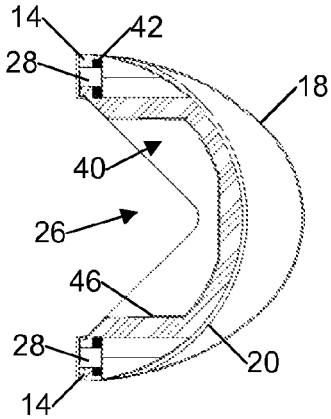
FIG. 7B is a cross-sectional view of the hub half on the lines 7B-7B of FIG. 7A.
Figure 7C:
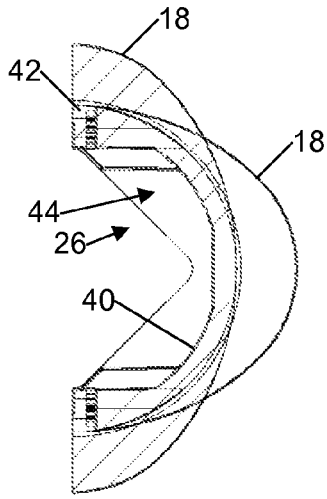
FIG. 7C is a cross-sectional view of the hub half on the lines 7*c*-7*c* of FIG. 7A.

Connecting portions 14 extend up to the radial end faces 34 of the hub halves 12 as best illustrated in FIGS. 2, 3, and 7B. In one embodiment, the connecting portions 14 are formed in on or more of the spacers 20. The connecting portions 14 include bores 28. The bores 28 in the corresponding connecting portions 14 of opposing hub halves 12 are aligned. Fastener devices 36 releasably secure opposing hub halves 12 about the shaft 24. The fastener devices 36 extend through the bores 28 in the connecting portions 14 of opposing hub halves 12. In one embodiment, the radial end faces 34 each have an elongate recess 38.

Figure 6:
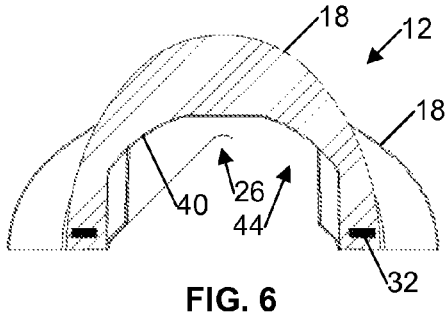
FIG. 6 is a cross sectional view of the hub half on the lines 6-6 of FIG. 5.
Figure 8:
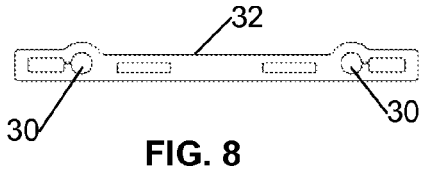
FIG. 8 is a top plan view of a rigid insert.

Rigid inserts 32 are shown in FIGS. 2 and 8. The rigid inserts 32 may be made of metal, such as cast Aluminum and have holes 30 configured for alignment with the bores 28 in the connecting portions 14. Rigid inserts 32 include bores 30. In one embodiment, the rigid inserts 32 are configured to interface with the radial end faces 34. In another embodiment, the rigid inserts 32 are configured to be received in elongate recesses 38 in the opposing radial end faces 34. In the illustrated embodiment, the rigid inserts 32 are embedded in the body of the hub half 12 proximate the radial end faces 34, as illustrated in FIGS. 6 and 7A. The holes 30 align with the bores 28 in the connecting pieces 14 of the hub halves 12. Each securing device 36 extends through the bores 28 in the connecting portions 14 and through the aligned hole 30 of the respective rigid insert 32. In one embodiment, the securing device is a stainless steel bolt or threaded fastener that extends through the bore in the bores 28 in the connection portions 14 and the bore 30 through the rigid insert 32. The male end is screwed into a female threaded nut. Other forms of securing means can be utilized, such as ancillary collars, clamps, brackets and/or sleeves for indirectly attaching the hub halves 12 in releasable fashion.

Referring to FIG. 3, a multi-disc assembly 18 is shown. Longitudinal separation plane 16 separates the two hub halves 12. Each of the discs 18 has a major and a minor axis. The major axes of adjacent discs 18 may be out of alignment by a predetermined angle. In one embodiment, the major axes of each pair of adjacent discs 18 on the multi-disc assembly 18 is out of alignment by approximately 90 degrees. Other angles may also be used. While five discs 18 are illustrated, often multi-disc hubs may have a greater or smaller number of integral discs. In one embodiment, the spacers 20 are circular and have a diameter approximately equal to the size of the minor axis of the discs 18. The connecting portions 14 are formed as flanges in portions of the spacers 20.

Figure 5:
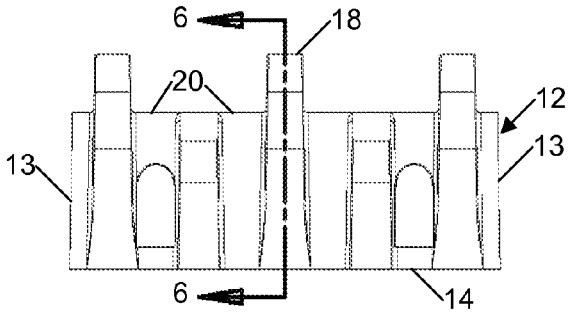
FIG. 5 is a side elevation view of one multi-disc hub half.

In one embodiment, the hub half 12 is molded from an elastomeric material. Each disc 18 has an inner surface 40 that defines a portion of an interior cavity 44 as shown in FIGS. 1, 3, and 5. The interior cavity 44 may be larger in a radial dimension than the through bore 26 in some areas, with inner surfaces 40 of at least some discs fitting closely about the shaft. Accordingly, the hub half 12 may contact the shaft 24 along less than entire length of the hub half 12. In one example, the hub half 12 contacts the shaft 24 in two areas near the end portions 13 of the hub half 12. Advantageously, this allows a sturdy connection between the hub half 12 and the shaft 24 while also allowing the hub half 12 to be formed of a smaller amount of material. In one embodiment, the hub half 12 is formed of an elastomeric material, i.e. a rubber-like synthetic polymer such as silicone rubber or polyurethane FIG. 7A is a bottom view of one hub half 12 which is broken away to reveal the embedded rigid insert 32 adjacent one radial end face 34. In this embodiment, a rigid insert 32 is positioned within the hub half 12 parallel with the radial end face 34. The holes 30 through the rigid insert 32 are aligned with the bores 28 through the two connecting portions 14. As shown in FIG. 7*b* the spacer 20 has an inner surface 46 that defines part of interior cavity 44. Thus, hub half 12 has rigid inserts embedded adjacent each radial end face 34. The opposing hub half may have similarly located rigid inserts or inserts may be located in only one hub half.

The hub halves 12 may be integrally molded as one unitary piece of elastomeric material in a mold (not illustrated), then separated into two halves along the separation plane 18. In one embodiment, the molding occurs after the rigid inserts 32 have been positioned within the mold. The use of synthetic rubber, polyurethane or other similar durable elastomeric materials ensures that the discs 18 will have high friction impacting surfaces to maximize their propelling. The use of elastomeric material also minimizes the likelihood that glass containers will be broken.

The multi-disc assembly 10 is easier to dismount and mount than prior multi-disc assemblies because it attaches directly to the shaft 24 without any intervening securing hubs or mounting plates.

While I have described alternate embodiments of my invention, variations and modifications will occur to those skilled in the art. For example, the through bore need not be rectangular, but could be circular, triangular, oval, etc. to accommodate shafts having matching outer cross-sections. The multi-disc assembly could also be made entirely of metal for the purpose of crushing glass. Therefore, the protection afforded my invention should only be limited in accordance with the scope of the following claims.

The invention claimed is:

1. A multi-disc assembly for releasable attachment to the shaft of a disc screen apparatus, comprising:

a multi-disc hub of elastomeric material including multiple discs configured for use in a material separation screen of a disc screen apparatus, the hub having a through bore configured for direct engagement over a shaft of a material separation screen;

the hub having a longitudinal separation plane which splits the hub into two separate multi-disc hub halves and defines first and second radial end faces in each hub half which extend along opposite sides of the through bore and oppose corresponding first and second radial end faces in the other hub half;

each hub half having at least one first connecting portion extending up to the first radial end face and at least one second connecting portion extending up to the second radial end face; and at least two fastener devices configured to releasably secure the hub halves together around the shaft, the fastener devices comprising at least a first fastener device configured to extend through the first connecting portions of the hub halves and a second fastener device configured to extend through the second connecting portions of the hub halves;

wherein each of the discs has a major axis and a minor axis, the major axes of adjacent pairs of discs offset from one another by a predetermined angle, wherein the predetermined angle is substantially 90 degrees.

2. The multi-disc assembly of claim 1, further comprising first and second rigid inserts between opposing hub halves and wherein the fastener devices extend through the rigid inserts.

3. The multi-disc assembly of claim 2, wherein the first and second rigid inserts are embedded in one of the multi-disc hub halves.

4. The multi-disc assembly of claim 1, wherein the through bore is configured to maintain the multi-disc hub in a fixed orientation with respect to the shaft of the material separation screen.

5. The multi-disc assembly of claim 1, wherein the multi-disc hub further comprises spacers between adjacent pairs of the discs.

6. The multi-disc assembly of claim 5, wherein the first and second connecting portions are formed in one of the spacers.

7. A material separation disc screen apparatus for separating materials, comprising:

a frame;

one or more shafts mounted on the frame in a substantially parallel relationship with each other; and one or more multi-disc assemblies mounted on each of the one or more shafts, each multi-disc assembly comprising, a multi-disc hub of elastomeric material including multiple discs configured for use in a material separation screen, the hub having a through bore configured for direct engagement over one of the one or more shafts;

the hub having a longitudinal separation plane which splits the hub into two separate multi-disc hub halves and defines first and second radial end faces in each hub half which extend along opposite sides of the through bore and oppose corresponding first and second radial end faces in the other hub half;

each hub half having at least one first connecting portion extending up to the first radial end face and at least one second connecting portion extending up to the second radial end face; and at least two fastener devices configured to releasably secure the hub halves together around the shaft, the fastener devices comprising at least a first fastener device configured to extend through the first connecting portions of the hub halves and a second fastener device configured to extend through the second connecting portions of the hub halves;

wherein each of the discs has a major axis and a minor axis, the major axes of adjacent pairs of discs offset by a predetermined angle, wherein the predetermined angle is substantially 90 degrees.

8. The material separation disc apparatus of claim 7, further comprising first and second rigid inserts between opposing hub halves and wherein the fastener devices extend through the rigid inserts.

9. The material separation disc apparatus of claim 8, wherein the first and second rigid inserts are embedded in one of the multi-disc hub halves.

10. The material separation disc apparatus of claim 1, wherein the through bore is configured to maintain the multi-disc hub in a fixed orientation with respect to the shaft of the material separation screen.

11. The material separation disc apparatus of claim 7, wherein the multi-disc hub further comprises spacers between adjacent pairs of the discs.

12. The material separation disc apparatus of claim 11, wherein the first and second connecting portions are formed in one of the spacers.

* * * * *